US009822779B2

(12) United States Patent
Kwak et al.

(10) Patent No.: US 9,822,779 B2
(45) Date of Patent: Nov. 21, 2017

(54) VANE ROTARY COMPRESSOR

(71) Applicant: Halla Visteon Climate Control Corp., Daejeon (KR)

(72) Inventors: Jung Myung Kwak, Daejeon (KR); In Cheol Shin, Daejeon (KR); Kweon Soo Lim, Daejeon (KR); Seon Joo Hong, Daejeon (KR)

(73) Assignee: HANON SYSTEMS, Daejeon-si (KR)

( * ) Notice: Subject to any disclaimer, the term of this patent is extended or adjusted under 35 U.S.C. 154(b) by 141 days.

(21) Appl. No.: 14/765,843

(22) PCT Filed: Jan. 29, 2014

(86) PCT No.: PCT/KR2014/000866
§ 371 (c)(1),
(2) Date: Aug. 5, 2015

(87) PCT Pub. No.: WO2014/123325
PCT Pub. Date: Aug. 14, 2014

(65) Prior Publication Data

US 2015/0369245 A1 Dec. 24, 2015

(30) Foreign Application Priority Data

Feb. 5, 2013 (KR) ..... 10-2013-0012992
Feb. 5, 2013 (KR) ..... 10-2013-0012994

(51) Int. Cl.
*F01C 21/00* (2006.01)
*F03C 2/00* (2006.01)
*F03C 4/00* (2006.01)
(Continued)

(52) U.S. Cl.
CPC ..... *F04C 18/321* (2013.01); *F01C 21/0809* (2013.01); *F01C 21/0863* (2013.01);
(Continued)

(58) Field of Classification Search
CPC ..... F04C 18/321; F04C 18/324; F04C 18/44; F04C 2/321; F04C 2/324; F04C 2/44; F01C 21/0809; F01C 21/0863
(Continued)

(56) References Cited

U.S. PATENT DOCUMENTS 4,415,322 A * 11/1983 Baudin ..... F01C 21/0809 418/260
4,990,074 A 2/1991 Nakagawa
(Continued)

FOREIGN PATENT DOCUMENTS

DE 622554 C 11/1935
GB 327153 A * 3/1930 ..... F04C 18/44
(Continued)

*Primary Examiner* — Theresa Trieu
(74) *Attorney, Agent, or Firm* — Shumaker, Loop & Kendrick, LLP; James D. Miller

(57) ABSTRACT

The present invention relates to a vane rotary compressor wherein the volume of a compression room is reduced and a fluid is compressed when a rotor rotates. According to one embodiment of the present invention, the present invention provides the vane rotary compressor for maximizing the rotational moment of a vane by extending a weight part at a front end part of the curved blade type vane so as to remove the hitting noise due to the delay of the rotational operation of the vane when the rotor is rotated, and increasing the performance by reducing the internal leak.

18 Claims, 11 Drawing Sheets

(51) Int. Cl.

| | |
|---|---|
| ***F04C 2/00*** | (2006.01) |
| ***F04C 18/32*** | (2006.01) |
| ***F01C 21/08*** | (2006.01) |
| ***F04C 2/32*** | (2006.01) |
| ***F04C 2/44*** | (2006.01) |
| ***F04C 18/44*** | (2006.01) |

(52) U.S. Cl.
CPC ..... *F04C 2/321* (2013.01); *F04C 2/44* (2013.01); *F04C 18/44* (2013.01); *F04C 2250/20* (2013.01)

(58) Field of Classification Search
USPC ..... 418/151, 266–268
See application file for complete search history.

(56) References Cited

U.S. PATENT DOCUMENTS

| | | | | |
|---|---|---|---|---|
| 6,371,745 | B1 * | 4/2002 | Bassine | F04C 2/44 418/268 |
| 2010/0143174 | A1 | 6/2010 | Radziwill | |
| 2014/0170010 | A1 * | 6/2014 | Kwak | F01C 21/0809 418/259 |

FOREIGN PATENT DOCUMENTS

| | | | | |
|---|---|---|---|---|
| GB | 2098278 | A | 11/1982 | |
| GB | 2169966 | A * | 7/1986 | F04C 2/44 |
| JP | 2002130169 | A | 5/2002 | |
| JP | 2010031759 | A | 2/2010 | |
| WO | 9848172 | A1 | 10/1998 | |
| WO | 2008050212 | A2 | 5/2008 | |

* cited by examiner

VANE ROTARY COMPRESSOR

CROSS-REFERENCE TO RELATED APPLICATIONS

This application is a United States national phase application based on PCT/KR2014/000866 filed Jan. 29, 2014 which claims the benefit of Korean Patent Application No. 10-2013-0012992 filed Feb. 5, 2013 and Korean Patent Application No. 10-2013-0012994 filed Feb. 5, 2013. The entire disclosures of the above applications are hereby incorporated herein by reference.

FIELD OF THE INVENTION

The present invention relates to a vane rotary compressor in which a fluid such as a refrigerant is compressed while a volume of a compression chamber is reduced when a rotor rotates.

BACKGROUND OF THE INVENTION

A vane rotary compressor is used for an air conditioner or the like and compresses a fluid such as refrigerant to supply the compressed fluid to the outside.

FIG. 1 is a cross-sectional view schematically illustrating a conventional vane rotary compressor disclosed in Japanese Patent Laid-open Publication No. 2010-31759. FIG. 2 is a cross-sectional view taken along line "A-A" in FIG. 1.

As illustrated in FIG. 1, the conventional vane rotary compressor, which is designated by reference numeral 10, includes a housing H configured of a rear housing 11 and a front housing 12 while defining an external appearance thereof, and a cylindrical cylinder 13 received within the rear housing 11.

In this case, the cylinder 13 has an inner peripheral surface having an oval sectional shape as illustrated in FIG. 2.

In the inside of the rear housing 11, a front cover 14 is coupled to the front of the cylinder 13 and a rear cover 15 is coupled to the rear of the cylinder 13. In addition, a discharge space Da is defined between an outer peripheral surface of the cylinder 13, an inner peripheral surface of the rear housing 11 facing the same, the front cover 14, and the rear cover 15.

A rotary shaft 17 passing through the cylinder 13 is rotatably installed to the front cover 14 and the rear cover 15. The rotary shaft 17 is coupled with a cylindrical rotor 18, and the rotor 18 rotates within the cylinder 13 along with the rotary shaft 17 when the rotary shaft 17 rotates.

As illustrated in FIG. 2, a plurality of slots 18*a* is radially formed on an outer peripheral surface of the rotor 18, a linear vane 20 is slidably received in each of the slots 18*a*, and lubricant oil is supplied into the slot 18*a*.

When the rotor 18 is rotated by the rotation of the rotary shaft 17, a tip portion of the vane 20 protrudes outward of the slot 18*a* and comes into close contact with the inner peripheral surface of the cylinder 13. In this case, a plurality of divided compression chambers 21 is provided, each being formed by the outer peripheral surface of the rotor 18, the inner peripheral surface of the cylinder 13, a pair of vanes 20 adjacent to each other, and a facing surface 14*a* of the front cover 14 and a facing surface 15*a* of the rear cover 15, which face the cylinder 13.

In the case of the vane rotary compressor, an intake stoke is a stroke in which the volume of the compression chamber 21 is increased whereas a compression stroke is a stroke in which the volume of the compression chamber 21 is decreased, according to the rotation direction of the rotor 18.

As illustrated in FIG. 1, the front housing 12 has a suction port 24 formed at an upper portion thereof, and a suction space Sa communicating with the suction port 24 is defined within the front housing 12.

The front cover 14 has an inlet 14*b* communicating with the suction space Sa, and a suction passage 13*b* communicating with the inlet 14*b* is formed to axially pass through the cylinder 13.

As illustrated in FIG. 2, discharge chambers 13*d* recessed inwards are provided at opposite sides of the outer peripheral surface of the cylinder 13. In this case, the pair of discharge chambers 13*d* communicates with the compression chambers 21 through associated discharge holes 13*a*, and forms a portion of the discharge space Da.

The rear housing 11 is provided with a high-pressure chamber 30 divided by the rear cover 15 so that a compressed refrigerant is introduced into the high-pressure chamber 30. That is, the inside of the rear housing 11 is divided into the discharge space Da and the high-pressure chamber 30 by the rear cover 15. In this case, any one of the pair of discharge chambers 13*d* is formed with an outlet 15*e* communicating with the high-pressure chamber 30.

Accordingly, when the rotor 18 and the vanes 20 rotate along with the rotation of the rotary shaft 17, a refrigerant is introduced from the suction space Sa via the inlet 14*b* and the suction passage 13*b* to each compression chamber 21. The refrigerant compressed by a reduction in volume of the compression chamber 21 is discharged to the discharge chamber 13*d* through the associated discharge hole 13*a* to be introduced into the high-pressure chamber 30 through the outlet 15*e*, and is then supplied to the outside through a discharge port 31.

Meanwhile, the high-pressure chamber 30 is provided with an oil separator 40 for separating lubricant oil from the compressed refrigerant introduced into the high-pressure chamber 30. An oil separation pipe 43 is installed at an upper portion of a case 41, and an oil separation chamber 42 into which the separated oil is dropped is formed beneath the oil separation pipe 43. Thus, the oil in the oil separation chamber 42 flows down into an oil storage chamber 32, which is formed in a lower portion of the high-pressure chamber 30, through an oil passage 41*b*.

The oil stored in the oil storage chamber 32 lubricates a sliding surface between the rear cover 15 and rotor 18 via a lubricant space of a bush, which supports a rear end of the rotary shaft 17, through an oil supply passage 15*d*. Subsequently, the oil is reintroduced into the outlet 15*e* through an oil return groove 45 by a difference in pressure between the discharge space Da and the high-pressure chamber 30.

However, since the vane 20 protrudes outward of the rotor 18 along the slot 18*a* in a case in which the linear vane 20 is applied to the conventional vane rotary compressor 10, hitting noise is caused while the tip portion of the vane 20 strikes the inner peripheral surface of the cylinder 13.

FIG. 3 is a cross-sectional view schematically illustrating a curved blade type vane rotary compressor disclosed in Japanese Patent Laid-open Publication No. 2002-130169.

The vane rotary compressor shown in FIG. 3 includes a cylindrical cylinder 1, a rotor 2, and a drive shaft 3. In this case, the cylinder 1 includes an inlet 1A and an outlet 1B and the rotor 2 is eccentrically installed within the cylinder 1.

A plurality of curved blade type vanes 4 is provided on an outer peripheral surface of the rotor 2 so that a plurality of divided compression chambers 6 is formed between the cylinder 1 and the rotor 2. One side of each of the vanes 4 is hinge-coupled to the outer peripheral surface of the rotor 2 by an associated hinge pin 5.

While the rotor 2 rotates by a predetermined angle from a time at which a compression stroke ends when the vane 4 passes through the outlet 1B to a time at which an intake stroke begins when the vane 4 passes through the inlet 1A, a back portion of the vane 4 is pressed toward rotor 2 by an inner peripheral surface of the cylinder 1 as illustrated in an enlarged view of FIG. 3. In this case, a tip portion of the vane 4 is spaced apart from the inner peripheral surface of the cylinder 1.

Subsequently, when the force applied to the back portion of the vane 4 is instantaneously removed as a gap between the outer peripheral surface of the rotor 2 and the inner peripheral surface of the cylinder 1 is increased by rotation of the rotor 2, the tip portion of the vane 4 comes into contact with the inner peripheral surface of the cylinder 1 while the vane 4 pivots and is unfolded from the rotor 2.

In this case, when the vane 4 folded by the rotor 2 is unfolded toward the inner peripheral surface of the cylinder 1 due to an increase in rotational moment of inertia of the vane 4 when the rotor 2 rotates at high speed, hitting noise is caused while the tip portion of the vane 4 strikes the inner peripheral surface of the cylinder 1.

In addition, the back portion of the vane 4 comes into contact with the inner peripheral surface of the cylinder 1 at the initial stage of the intake stroke and the vane 4 is rapidly unfolded from the rotor 2 after the intake stroke somewhat proceeds, so that the tip portion of the vane 4 is supported by the inner peripheral surface of the cylinder 1. Therefore, the volume of the compression chamber 6 is not smoothly expanded, resulting in a reduction of suction flow rate.

Meanwhile, since a center of gravity of the vane 4 is formed in the vicinity of the hinge coupling portion between the vane 4 and the rotor 2 in the conventional curved blade type vane 4, the vane 4 has a small rotational moment when the rotor 2 rotates.

For this reason, an internal leak is generated by a delay of a rotation operation time until the vane 4 is unfolded from the rotor 2 and the tip portion of the vane 4 comes into contact with the inner peripheral surface of the cylinder 1. The internal leak causes a reduction of compression flow rate of the refrigerant.

The above description is will be given in more detail with reference to FIG. 4.

FIG. 4 is a view schematically illustrating forces acting on the curved blade type vane 4 when the rotor 2 rotates.

In the vane rotary compressor illustrated in FIG. 3, the vane 4 is unfolded from the rotor 2 when the rotor 2 rotates and the tip portion of the vane 4 comes into close contact with the inner peripheral surface of the cylinder 1, thereby forming the compression chamber 6.

The forces applied to the vane 4 will be described according to action directions thereof with reference to FIGS. 3 and 4. A centrifugal force A1 according to rotation of the rotor 2 and a rotational moment A2 according to a center of gravity of the vane 4 act as forces of pushing and rotating the tip portion of the vane 4 toward the inner peripheral surface of the cylinder 1.

On the contrary, a hinge friction force B1 of the vane 4, a rotational moment of inertia B2, a fluid resistance B3 of a refrigerant in the compression chamber 6, a friction force B4 between the vane 4 and the cylinder 1, and a viscosity B5 of lubricant oil act as forces of pulling the tip portion of the vane 4 toward the outer peripheral surface of the rotor 2.

In this case, when the forces B1 to B5 of pulling the tip portion of the vane 4 toward the outer peripheral surface of the rotor 2 are larger than the forces A1 and A2 of pushing the tip portion of the vane 4 toward the inner peripheral surface of the cylinder 1, a gap is formed between the vane 4 and the cylinder 1 as illustrated in FIG. 4.

In this case, the compression chamber 6 is not fully sealed by the vane 4 and an internal leak is generated between the compression chamber 6 and the adjacent compression chamber 6, thereby causing a reduction of compression flow rate of the refrigerant.

In addition, the gap between the vane 4 and the cylinder 1 is gradually increased during a delay of rotation operation of the vane 4. Accordingly, there is a problem in that hitting noise is caused when the tip portion of the vane 4 instantaneously comes into contact with the inner peripheral surface of the cylinder 1 due to the centrifugal force A1 according to rotation of the rotor 2 and the rotational moment A2 of the vane 4.

In addition, in the conventional vane rotary compressor, the tip portion of the vane 4 has a rounded arc shape. The tip portion of the vane 4 is rubbed against the inner peripheral surface of the cylinder 1 when the rotor 2 rotates, and thus a contact shifting distance shifted along the tip portion of the vane 4 is very short. As a result, friction characteristics similar to sliding friction are exhibited in the vane 4 on the inner peripheral surface of the cylinder 1.

Wear between the tip portion of the vane 4 and the inner peripheral surface of the cylinder 1 is increased as friction is locally generated due to the above friction characteristics, and durability of the compressor is deteriorated by generation of noise and internal leak when the compressor is driven for a long time due to the above friction characteristics.

SUMMARY OF THE INVENTION

Accordingly, the present invention has been made in view of the above-mentioned problems, and an object thereof is to provide a vane rotary compressor capable of preventing hitting noise due to a delay of rotation operation of a vane when a rotor rotates by maximizing rotational moment of the vane and of having enhanced performance by reducing an internal leak.

In addition, another object of the present invention is to provide a vane rotary compressor capable of preventing an internal leak and having increased durability by reducing friction generated between a tip portion of a vane and an inner peripheral surface of a cylinder.

In accordance with an aspect of the present invention, a vane rotary compressor includes a hollow cylinder having an inlet formed at one side thereof, a rotor installed in the hollow to be rotated by receiving power from a drive source, and a vane, one end of which is hinge-coupled to one side of an outer peripheral surface of the rotor so that the vane rotates toward an inner peripheral surface of a cylinder, wherein the vane has a weight part formed at a tip portion thereof such that a center of gravity of the vane is formed at one side of the tip portion of the vane.

The vane rotary compressor may further include a counter weight provided in the weight part.

The counter weight may be made of a material having a greater specific gravity than that of the vane.

The vane may include a hinge part hinge-coupled to one side of the outer peripheral surface of the rotor, a blade part extending from one side of the hinge part in a curved manner, and a weight part formed at an end of the blade part, and the center of gravity of the vane may be positioned away from the hinge part to be formed at one side of the weight part.

A protrusion part convexly protruding toward the inner peripheral surface of the cylinder may be formed outside the weight part.

The weight part may have a larger width than that of the blade part.

The weight part may have a circular cross-sectional shape.

The weight part may have an oval cross-sectional shape.

The weight part may have a polygonal cross-sectional shape.

One side of the weight part facing the inner peripheral surface of the cylinder may have a curved surface and the other side of the weight part facing the outer peripheral surface of the rotor may have a flat surface.

When the rotor rotates, the weight part may come into contact with the inner peripheral surface of the cylinder in a rolling friction manner.

A contact point between the weight part and the inner peripheral surface of the cylinder may be shifted along one side edge of the weight part.

The contact point may be shifted in a direction of rotation of the rotor during an intake stroke, and the contact point may be shifted in a direction opposite to rotation of the rotor during a compression stroke.

The weight part may be configured such that a shifting section of the contact point is formed in an oval arc form having a predetermined curvature.

The inner peripheral surface of the hollow of the cylinder may have an involute curve form in a circumferential direction when viewed in section.

In accordance with another aspect of the present invention, a vane rotary compressor includes a hollow cylinder having an inlet formed at one side thereof, a rotor eccentrically installed in the hollow to be rotated by receiving power from a drive source, and a vane configured such that a hinge part is hinge-coupled to one side of an outer peripheral surface of the rotor and a blade part extends from one side of the hinge part, wherein a weight part having a larger width than that of the blade part is formed at an end of the blade part, and the weigh part comes into contact with the inner peripheral surface of the cylinder in a rolling friction manner along a shifting section of a contact point formed on one side edge of the weight part.

The vane rotary compressor may further include a counter weight provided in the weight part.

The counter weight may be made of a material having a greater specific gravity than that of the vane.

A center of gravity of the vane may be positioned away from the hinge part to be formed at one side of the weight part.

The contact point may be shifted in a direction of rotation of the rotor during an intake stroke, and the contact point may be shifted in a direction opposite to rotation of the rotor during a compression stroke.

The weight part may be configured such that the shifting section of the contact point is formed in an oval arc form having a predetermined curvature.

Additional advantages, objects, and features of the invention will be set forth in part in the description which follows and in part will become apparent to those having ordinary skill in the art upon examination of the following or may be learned from practice of the invention.

BRIEF DESCRIPTION OF DRAWINGS

The above and other objects, features and other advantages of the present invention will be more clearly understood from the following detailed description taken in conjunction with the accompanying drawings, in which.

DETAILED DESCRIPTION OF EXEMPLARY EMBODIMENTS OF THE INVENTION

Figure 1:
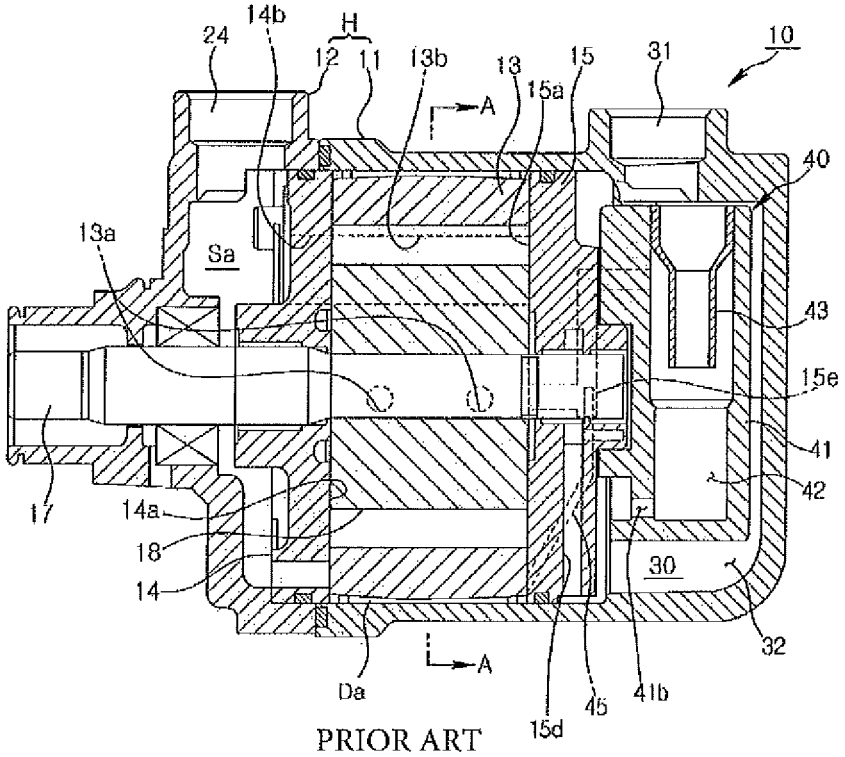
PRIOR ART FIG. 1
FIG. 1 is a vertical cross-sectional view schematically illustrating a conventional vane rotary compressor.
Figure 2:
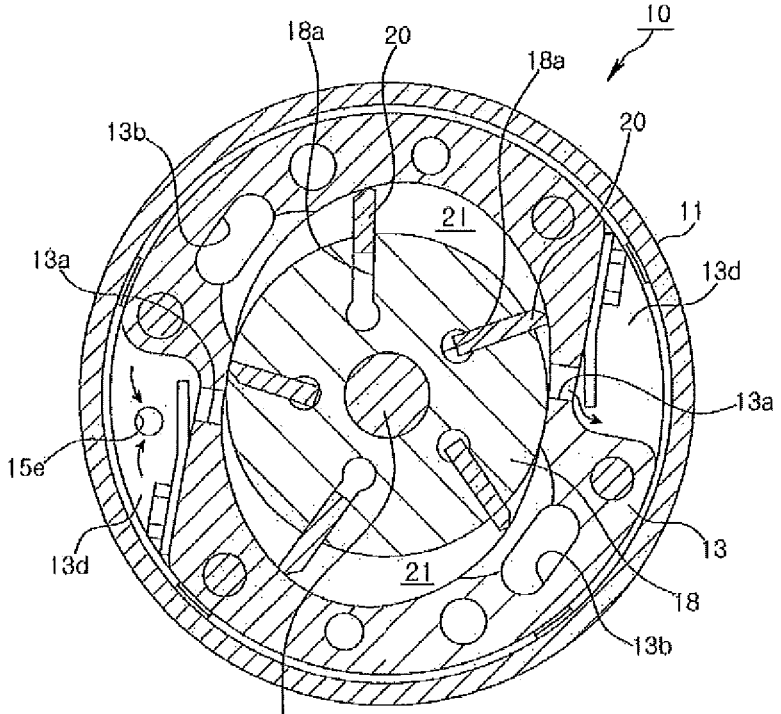
PRIOR ART FIG. 2
FIG. 2 is a cross-sectional view taken along line "A-A" in FIG. 1.

Hereinafter, a vane rotary compressor according to exemplary embodiments of the present invention will be described with reference to the accompanying drawings. In the description, the thickness of each line or the size of each component illustrated in the drawings may be exaggerated for convenience of description and clarity.

In addition, terms used herein are terms defined in consideration of functions of the present invention, and these may vary with the intention or practice of a user or an operator. Therefore, such terms should be defined based on the entire content disclosed herein.

Furthermore, the following embodiments are for the purpose of illustratively describing the components set forth in the appended claims only and are not intended to limit the spirit and scope of the invention. More particularly, various variations and modifications are possible in concrete constituent elements of the embodiments, and it is to be understood that differences relevant to the variations and modifications fall within the spirit and scope of the present disclosure defined in the appended claims.

In addition, although an example in which a vane rotary compressor has an external appearance defined by coupling of a housing and a second head part and a cylinder is received in the housing is described in the embodiments below, it is understood that the present invention is not limited to coupling of the housing defining the external appearance of the vane rotary compressor, the head part, and the cylinder.

First Embodiment

Figure 5:
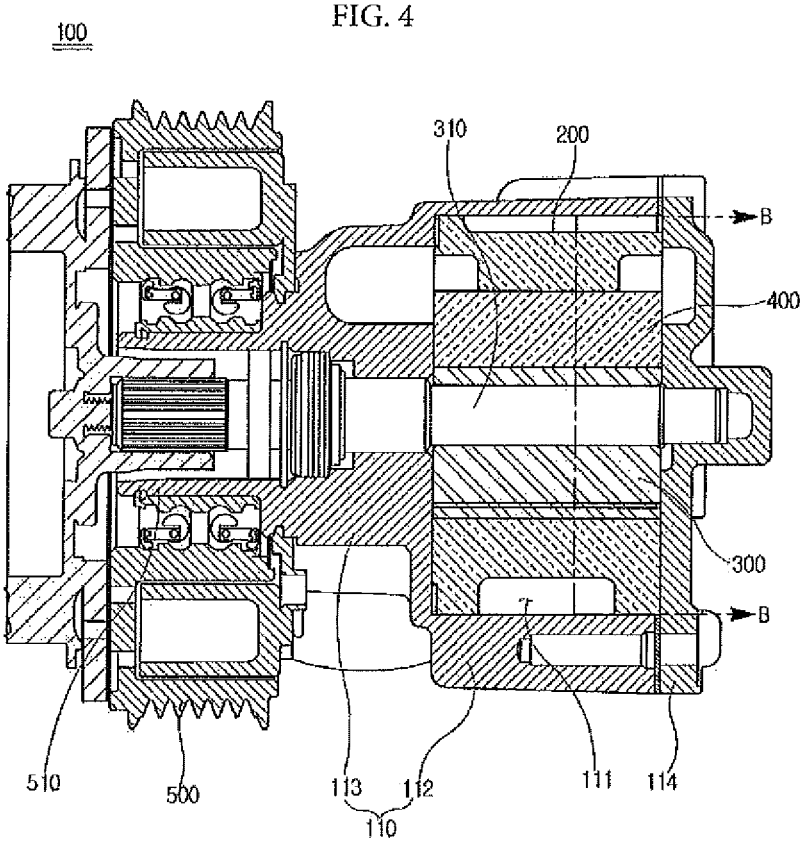
FIG. 5 is a vertical cross-sectional view illustrating a vane rotary compressor according to a first embodiment of the present invention.

FIG. 5 is a vertical cross-sectional view illustrating a vane rotary compressor according to a first embodiment of the present invention.

As illustrated in FIG. 5, the vane rotary compressor (hereinafter, referred to as "a compressor"), which is designated by reference numeral 100, according to the first embodiment of the present invention may generally have an external appearance defined by coupling of a housing 110 and a second head part 114.

The housing 110 includes a cylinder part 112 having a space part 111 formed therein, and a first head part 113 which is integrally formed with the cylinder part 112 in the axial front thereof and closes the front of the space part 111. A hollow cylinder 200 is mounted in the space part 111.

In this case, the cylinder 200 is provided therein with a rotary shaft 310 which rotates by power of a drive source, a rotor 300 which rotates along with the rotary shaft 310 by receiving torque from the rotary shaft 310, and a plurality of vanes 400 which is hinge-coupled to an outer peripheral surface of the rotor 300 to be rotatable in a radial direction of the rotor 300.

In addition, the second head part 114 is coupled to the axial rear of the housing 110 to close the rear of the space part 111.

Meanwhile, a suction port (not shown) for suction of a refrigerant from the outside and a discharge port (not shown) for discharge of a high-pressure refrigerant compressed within the cylinder 200 to the outside are provided on an outer peripheral surface of the first head part 113 of the housing 110 so as to be circumferentially spaced apart from each other.

In this case, a pulley coupling part 510 extends such that a pulley 500 of an electronic clutch (not shown) is coupled to a front center of the first head part 113.

Figure 6:
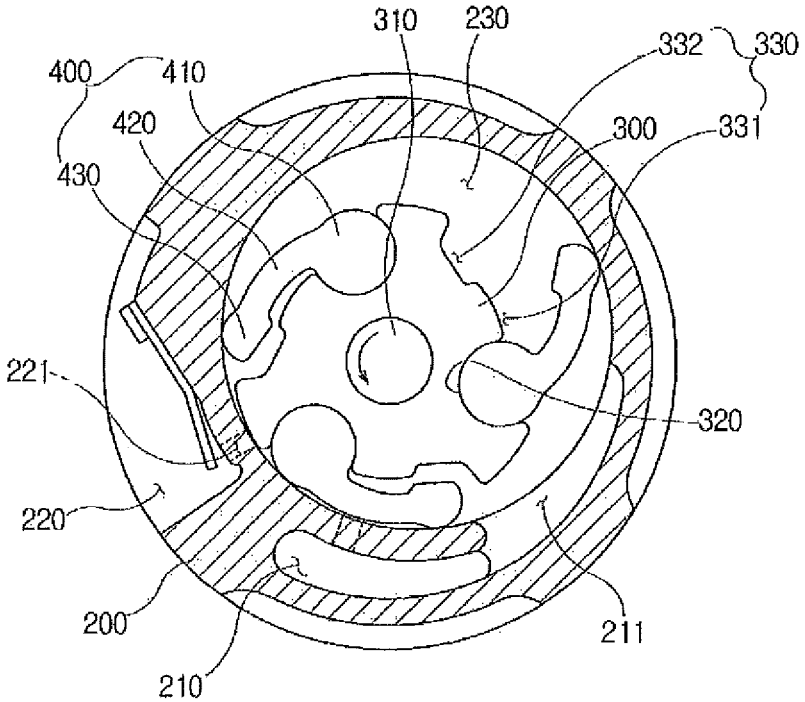
FIG. 6 is a cross-sectional view taken along line "B-B" in FIG. 5.
Figure 7:
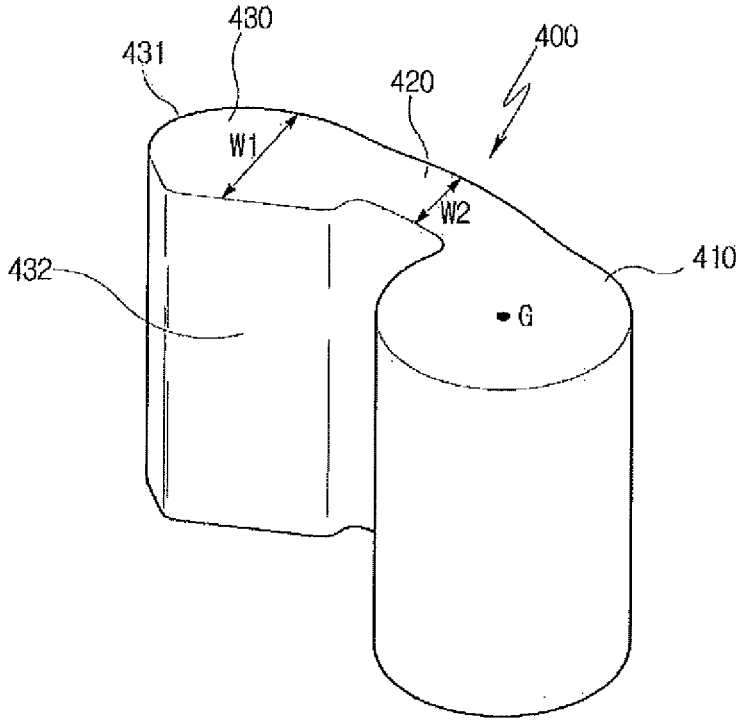
FIG. 7 is a perspective view illustrating a vane according to the first embodiment of the present invention.

FIG. 6 is a cross-sectional view taken along line "B-B" in FIG. 5. FIG. 7 is a perspective view illustrating the vanes 400 according to the first embodiment of the present invention.

As illustrated in FIG. 6, the cylinder 200 has a hollow which is slightly off-centered to one side from a center of the cylinder 200 in which the rotary shaft 310 is installed. The rotor 300 with the vanes 400 is inserted into and mounted in the hollow of the cylinder 200, so that the hollow of the cylinder 200 forms a compression space in which the introduced refrigerant is compressed by rotation of the rotor 300.

In this case, the cylinder 200 has a suction hole 210 formed at one side thereof. One side of the suction hole 210 communicates with the suction port of the first head part 113, and the other side thereof communicates with an inlet 211 communicating with the compression space in the cylinder 200. Consequently, the refrigerant, which is introduced through the suction port from the outside, flows into the hollow of the cylinder 200 as the compression space via the inlet 211 and the suction hole 210 of the cylinder 200.

In addition, a discharge part 220, through which the high-pressure compressed refrigerant is discharged, is formed to be recessed from one side of the outer peripheral surface of the cylinder 200. A plurality of outlets 221 communicating with compression chambers 230 to be described later is formed at one side of the discharge part 220 so as to penetrate the same, and a guide passage (not shown) for guiding the high-pressure refrigerant toward the discharge port is formed at the other side of the discharge part 220.

The rotor 300 is coupled to the rotary shaft 310, which is connected to a clutch (not shown) driven by a drive motor (not shown) or an engine belt (not shown), to axially rotate along with the rotary shaft 310.

In this case, the rotary shaft 310 is mounted along a central axis of the cylinder 200. Accordingly, the rotor 300 deviates slightly to one side from the center of the hollow of the cylinder 200, thereby rotating at an eccentric position in the hollow of the cylinder 200.

The plurality of curved blade type vanes 400 are spaced apart from each other and are hinge-coupled to the outer peripheral surface of the rotor 300. In this case, one side of each vane 400 is hinge-coupled to a slot 320 on the outer peripheral surface of the rotor 300, and a tip portion of the other side of the vane 400 rotates toward the inner peripheral surface of the cylinder 200 by centrifugal force and the pressure of the refrigerant when the rotor 300 rotates. As a result, the compression space is divided into a plurality of compression chambers 230.

That is, each compression chamber 230 is formed by a space defined by a pair of adjacent vanes 400, the outer peripheral surface of the rotor 300, and the inner peripheral surface of the cylinder 200.

Although an example in which three vanes 400 are provided along the outer peripheral surface of the rotor 300 is illustrated in the present embodiment, the number of vanes 40 may be properly selected as occasion demands.

The tip portion of each vane 400 rotates along the inner peripheral surface of the hollow of the cylinder 200 in a rotation direction of the rotor 300 along with rotation of the rotor 300. In this case, as the rotor 300 is eccentrically located in the hollow, a gap between the outer peripheral surface of the rotor 300 and the inner peripheral surface of the hollow of the cylinder 200 is gradually narrowed during rotation of the rotor 300, with the consequence that the volume of the compression chamber 230 is reduced and the refrigerant in the compression chamber 230 is compressed.

In this case, in order to maximally reduce the volume of the compression chamber 230 during a compression stroke, the rotor 300 is eccentrically arranged such that one side of the outer peripheral surface of the rotor 300 comes into contact with the inner peripheral surface of the hollow of the cylinder 200.

To this end, a plurality of receiving grooves 330 for receiving the vanes 400 is circumferentially formed on the outer peripheral surface of the rotor 300 in the same number as that of the vanes 400. In this case, each of the receiving grooves 330 includes a blade part receiving groove 331 for receiving a blade part 420 of the associated vane 400 to be described later, and a weight part receiving groove 332 for receiving a weight part 430 of the vane 400.

As illustrated in FIGS. 6 and 7, each of the vanes 400 includes a hinge part 410 which is hinge-coupled to one side of the outer peripheral surface of the rotor 300, the blade part 420 extending from one side of the hinge part 410 in a curved manner, and the weight part 430 formed to have an enlarged width at an end of the blade part 420.

In this case, the hinge part 410 of the vane 400 is hinge-coupled to one side of the outer peripheral surface of the rotor 300, and the hinge part 410 having a circular cross-sectional shape is rotatably coupled to the slot 320 which has an arc cross-sectional shape and is formed at one side of the outer peripheral surface of the rotor 300. In this case, the hinge part 410 is preferably formed so as not to deviate in a radial and outward direction of the rotor 300.

The blade part 420 of the vane 400 extends so as to be curved toward the inner peripheral surface of the hollow of the cylinder 200 from one side of the hinge part 410, and the weight part 430 is formed at the end of the blade part 420.

In this case, the blade part 420 is preferably formed inside an imaginary circle in which the hinge part 410 and the weight part 430 are simultaneously inscribed. In this case, when the rotor 300 rotates, the vane 400 is configured such that the weight part 430 comes into contact with the inner peripheral surface of the hollow of the cylinder 200 or the weight part 430 and the hinge part 410 simultaneously come into contact with the inner peripheral surface of the hollow of the cylinder 200, and the blade part 420 is always spaced apart from the inner peripheral surface of the cylinder 200.

The weight part 430 has a larger width w1 than a width w2 of the blade part 420, so that a center of gravity of the vane 400 is positioned far away from a hinge center G of the hinge part 410 to be formed close to the weight part 430.

In addition, an outer side of the weight part 430, namely, one side facing the inner peripheral surface of the cylinder 200 is formed to have a protruding curved surface 431 having a predetermined curvature. When the rotor 300 rotates, the curved surface 431 is maintained in a state of always coming into contact with the inner peripheral surface of the hollow of the cylinder 200.

In addition, an inner side of the weight part 430, namely, the other side facing the outer peripheral surface of the rotor 300 is preferably formed to have a flat surface 432. Thereby, the volume of the inner side of the weight part 430 is reduced and a center of gravity of the weight part 430 is biased outwardly, namely, toward the inner peripheral surface of the cylinder 200.

As described above, when the weight part 430 is formed at the tip portion of the vane 400, the center of gravity of the vane 400 positioned close to the hinge part 410 in the related art is shifted toward the weight part 430.

Figure 8:
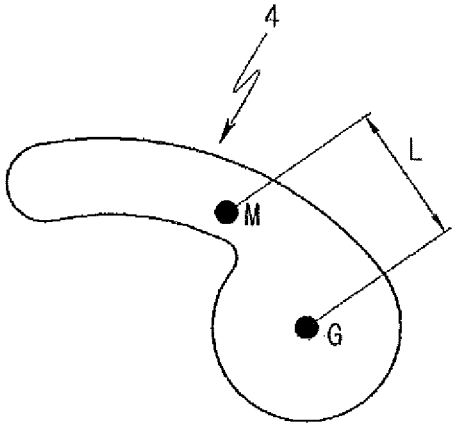
PRIOR ART FIG. 8
FIG. 8 is a view schematically illustrating a position at which a center of gravity of the conventional vane is formed.
Figure 9:
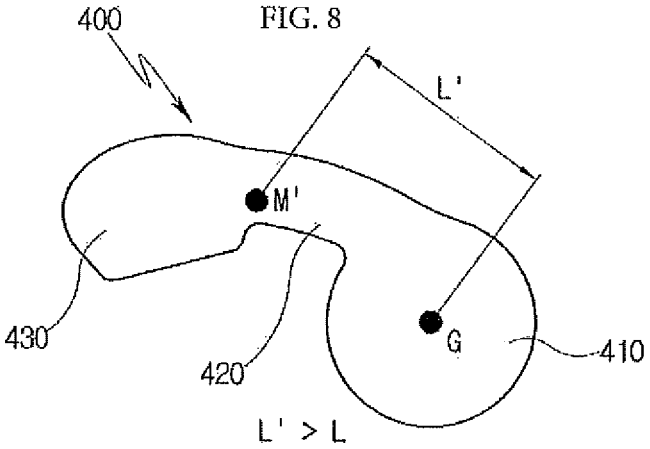
FIG. 9 is a view schematically illustrating a position at which a center of gravity of the vane according to the first embodiment of the present invention is formed.

The position of the center of gravity of the vane shifted toward the weight part 430 according to the embodiment of the present invention may be compared with the position of the center of gravity of the conventional vane with reference to FIGS. 8 and 9.

A distance between the hinge center G and a center of gravity M' of the vane 400 according to the embodiment of the present invention illustrated in FIG. 9 is greater than a distance L between a hinge center G and a center of gravity M of the conventional vane 4 illustrated in FIG. 8.

Thus, the rotational moment of the vane 400 according to the embodiment of the present invention when the rotor 300 rotates is greater compared to that of the related art. Therefore, it is possible to prevent generation of hitting noise caused due to the delay of rotation operation of the vane as in the related art.

In addition, since the tip portion of the vane 400 is maintained in a state of coming into close contact with the inner peripheral surface of the cylinder 200 by the rotational moment of the vane 400, it is possible to decrease an internal leak caused by generation of the gap as in the related art and increase performance of the compressor 100.

FIGS. 10 to 13 are cross-sectional views illustrating an operation state of the vane rotary compressor according to the embodiment of the present invention.

In accordance with the embodiment of the present invention, the rotational moment of the vane 400 is increased by the weight part 430 formed at the tip portion of the vane 400.

Figure 10:
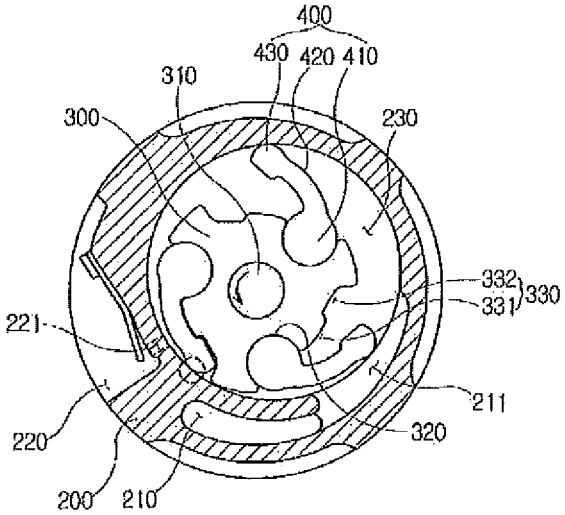
FIGS. 10 to 13 are cross-sectional views illustrating an operation state of the vane rotary compressor according to the first embodiment of the present invention.
Figure 11:
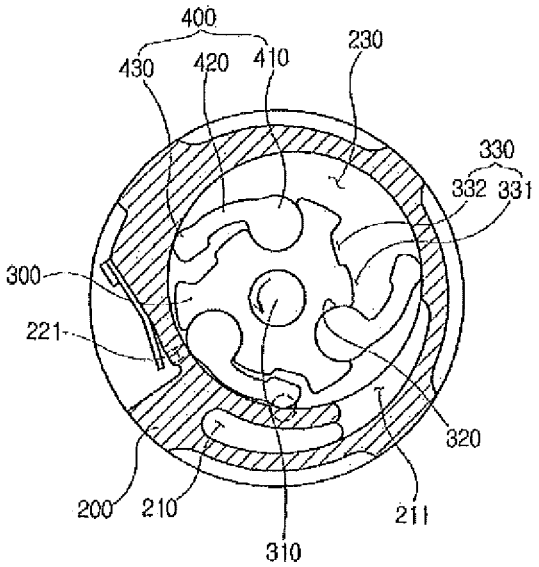
Figure 12:
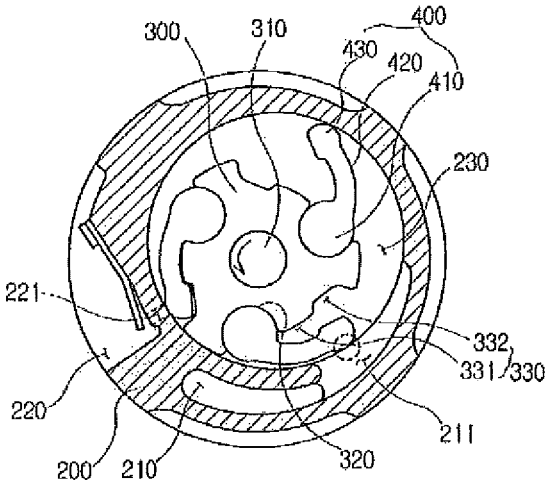
Figure 13:
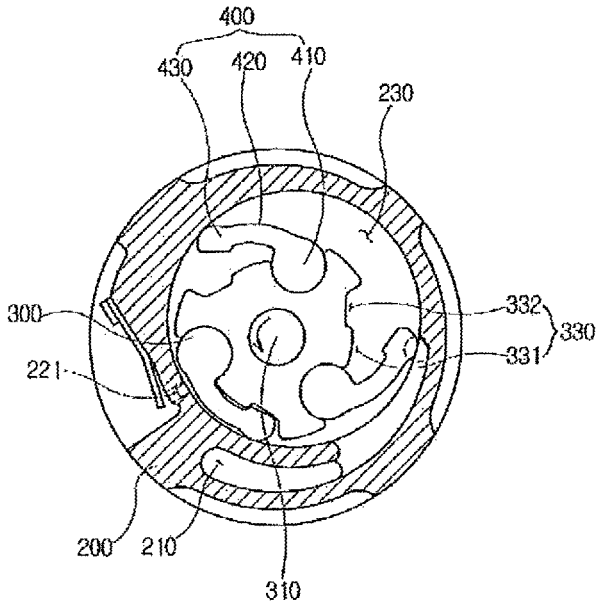

Thus, as illustrated by the dotted circle in the drawings, the weight part 430 is always maintained in a state of coming into contact with the inner peripheral surface of the cylinder 200 by the rotational moment of the vane 400 during a compression stroke (see FIGS. 10 and 11).

In addition, the vane 400 folded in the receiving groove 330 of the rotor 300 is rapidly unfolded toward of the inner peripheral surface of the cylinder 200 during an intake stroke (see FIGS. 12 and 13), and the weight part 430 comes into contact with inner peripheral surface of the cylinder 200 as illustrated by the dotted circle in the drawings.

Therefore, it is possible to prevent generation of the gap between the vane 400 and the cylinder 200 caused due to the delay of rotation operation of the vane as in the related art and thus the hitting noise and the internal leak. Consequently, the compressor 100 may have improved durability and efficiency.

Second Embodiment

Figure 14:
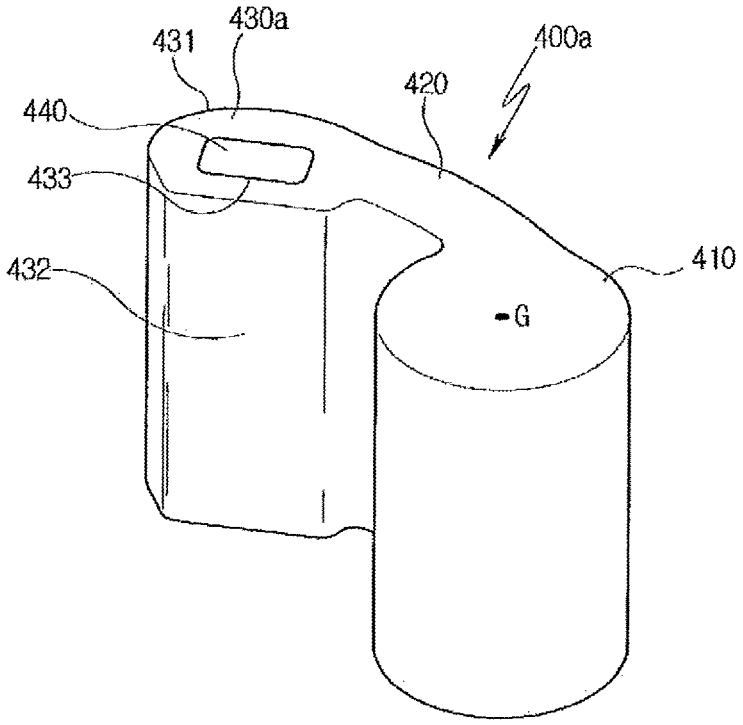
FIG. 14 is a perspective view illustrating a vane according to a second embodiment of the present invention.

FIG. 14 is a perspective view illustrating a vane 400*a* according to a second embodiment of the present invention.

The second embodiment of the present invention generally has configurations similar to those of the above-mentioned first embodiment, but differs from the first embodiment in that a counter weight 440 is inserted into a weight part 430*a* of each vane 400*a*. Accordingly, the same configurations as those of the above-mentioned first embodiment are designated by the like reference numerals and duplicated description thereof will be omitted.

In accordance with the vane 400*a* according to the second embodiment of the present invention, a weight of the weight part 430*a* is increased compared to the above-mentioned first embodiment, and thus a rotational moment of the vane 400*a* is also increased.

In this case, the weight part 430*a* is formed with an insertion groove 433 having a predetermined depth and the counter weight 440 is inserted into the insertion groove 433. Requirements such as a width and a thickness of the counter weight 440 may be properly selected as occasion demands.

However, the counter weight 440 preferably has a length equal to or less than a height of the weight part 430*a*, in order to seal a gap between the compression chambers 230.

In addition, since the counter weight 440 is inserted into the weight part 430*a* in order to increase the weight of the weight part 430*a*, the counter weight 440 is preferably made of a material having a greater specific gravity than that of the vane 400*a*.

For example, when the vane 400*a* is made of an aluminum material, the counter weight 440 may be made of steel having a greater specific gravity than aluminum,

Third Embodiment

Figure 15:
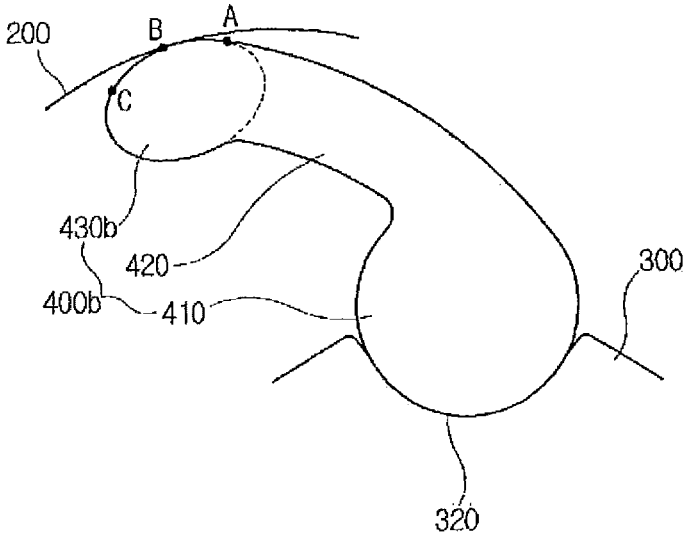
FIG. 15 is a perspective view illustrating a vane according to a third embodiment of the present invention.

FIG. 15 is a perspective view illustrating a vane 400*b* according to a third embodiment of the present invention.

The third embodiment of the present invention generally has configurations similar to those of the above-mentioned first embodiment, but differs from the first embodiment in that a weight part 430*b* of each vane 400*b* has an oval cross-sectional shape. Accordingly, the same configurations as those of the above-mentioned first embodiment are designated by the like reference numerals and duplicated description thereof will be omitted.

In the third embodiment of the present invention, the vane 400*b* includes the hinge part 410 which is hinge-coupled to one side of the outer peripheral surface of the rotor 300, the blade part 420 extending from one side of the hinge part 410 in a curved manner, and the weight part 430*b* formed at an end of the blade part 420.

In this case, the blade part 420 may have an outside surface formed to have a curvature corresponding to the inner peripheral surface of the hollow of the cylinder 200, and the outside surface of the blade part 420 is preferably formed inside an imaginary circle in which the hinge part 410 and the weight part 430*b* are simultaneously inscribed. That is, an outside edge of the weight part 430*b* is arranged inside an imaginary arc connecting one side of the hinge part 410 to one side of the weight part 430*b*.

The weight part 430*b* is formed at the end of the blade part 420. An outside surface of the weight part 430*b*, namely, a surface facing the inner peripheral surface of the cylinder 200 is formed in an oval arc form having a predetermined curvature when viewed in section, as illustrated by the dotted line in FIG. 15.

In this case, when the rotor 300 rotates, the vane 400*b* is maintained in a state in which the weight part 430*b* always comes into contact with the inner peripheral surface of the cylinder 200. A contact point between the weight part 430*b* and the inner peripheral surface of the cylinder 200 is shifted along a contact shifting section (A~C) on the outside surface of the weight part 430*b*.

Figure 3:
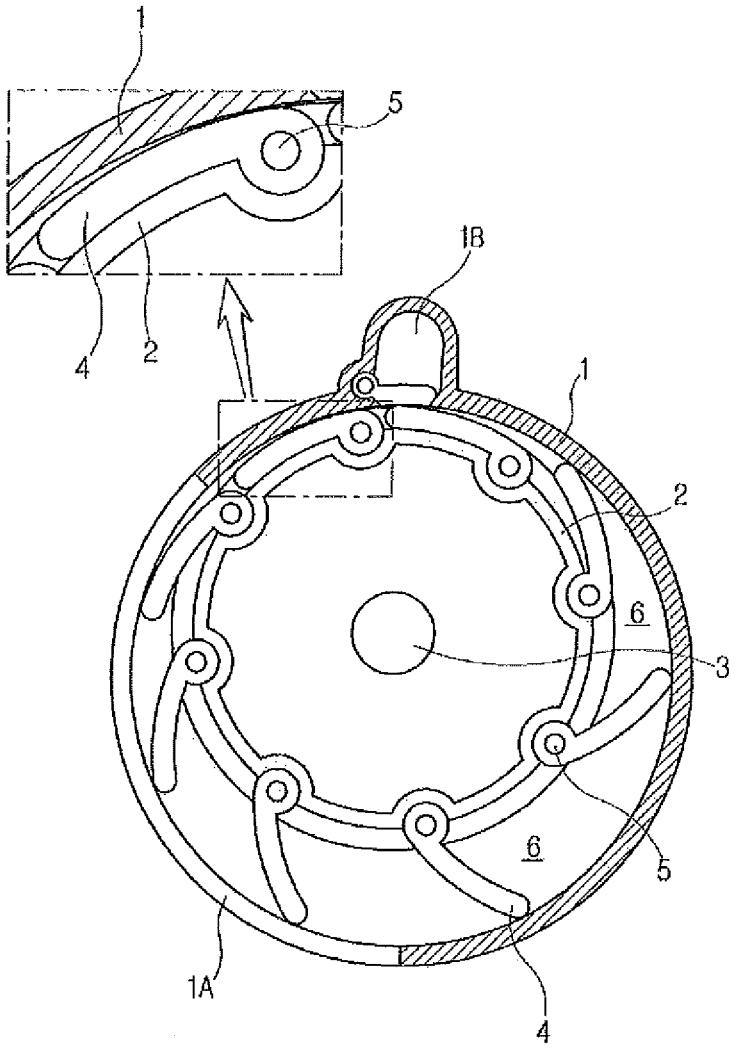
PRIOR ART FIG. 3
FIG. 3 is a cross-sectional view illustrating a conventional curved blade type vane rotary compressor.
Figure 4:
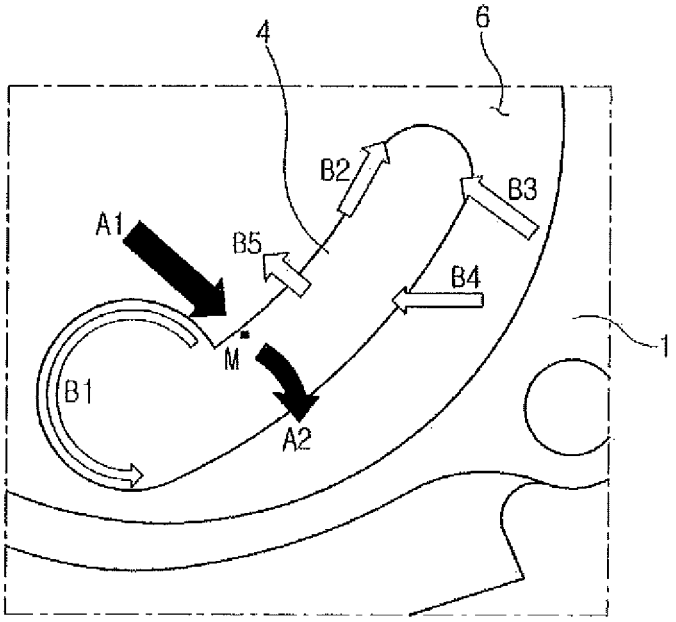
PRIOR ART FIG. 4
FIG. 4 is a view schematically illustrating forces acting on a vane when a rotor rotates.

That is, since the tip portion of the vane 400*b* is moved along the inner peripheral surface of the cylinder 200 in a rolling friction manner according to the contact shifting section (A~C) of the weight part 430*b*, the third embodiment surely exhibits rolling friction characteristics compared to the conventional vane rotary compressor having a very short contact shifting distance (see FIG. 3).

Accordingly, the third embodiment of the present invention has an advantage of preventing noise and an internal leak by a reduction in wear since the tip portion of the vane 400*b* is moved in the rolling friction manner, in addition to an increase in rotational moment by formation of the weight part 430*b*. Therefore, the compressor may have improved durability.

Figure 16:
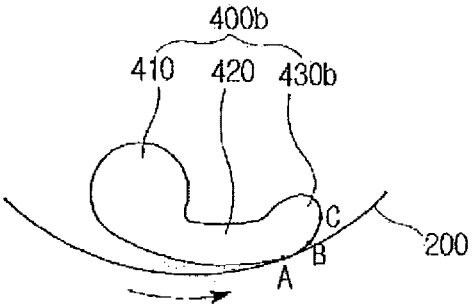
FIGS. 16 to 18 are cross-sectional views illustrating a shifting direction of a contact point between a weight part and an inner peripheral surface of a cylinder when viewed in section during an intake stroke according to the third embodiment of the present invention.
Figure 17:
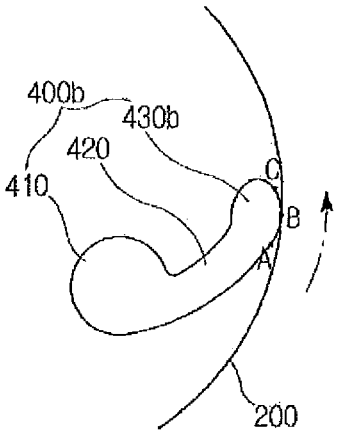
Figure 18:
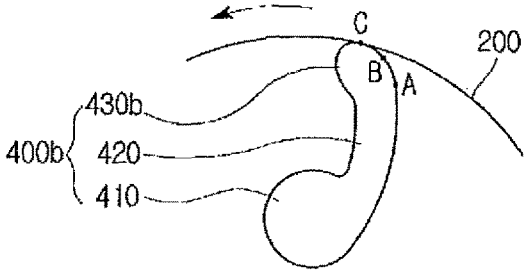
Figure 19:
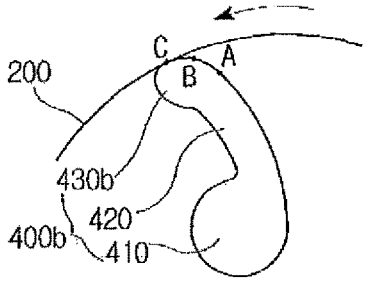
FIGS. 19 to 21 are cross-sectional views illustrating a shifting direction of a contact point between a rolling friction part and an inner peripheral surface of a cylinder when viewed in section during a compression stroke according to the third embodiment of the present invention.
Figure 20:
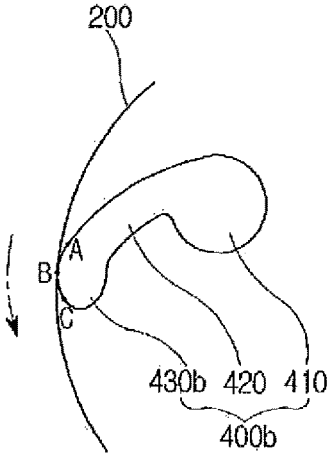
Figure 21:
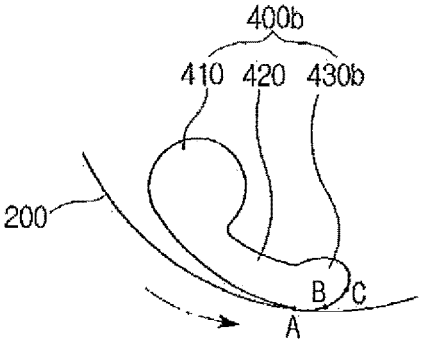

FIGS. 16 to 18 are cross-sectional views illustrating a shifting direction of the contact point between the weight part 430*b* and the inner peripheral surface of the cylinder 200 when viewed in section during an intake stroke according to the third embodiment of the present invention. FIGS. 19 to 21 are cross-sectional views illustrating a shifting direction of a contact point between the weight part 430*b* and the inner peripheral surface of the cylinder 200 when viewed in section during a compression stroke according to the third embodiment of the present invention.

In the third embodiment of the present invention, the vane 400*b* is unfolded toward the inner peripheral surface of the cylinder 200 from the receiving groove 330 of the rotor 300 by rotation of the rotor 300 during the intake stroke of the compressor 100. In this case, the contact point between the outside surface of the weight part 430*b* and the inner peripheral surface of the cylinder 200 is shifted in the same direction (A→C) as the rotation direction (direction indicated by the arrow) of the rotor 300 as illustrated in FIGS. 16 to 18.

In this case, friction is increased since the rotation direction is equal to the contact shifting direction, but generation of wear is minimized since a load in the compression chamber 230 is small during the intake stroke.

In addition, since the weight part 430*b* is formed at the end of the blade part 420, a center of gravity of the vane 400*b* is positioned away from a hinge center of the hinge part 410 to be formed close to the weight part 430*b*.

Accordingly, since the rotational moment of the vane 400*b* is increased by an increase in weight of the tip portion of the vane 400*b* by the weight part 430*b*, the tip portion of the vane 400*b* rapidly comes into close contact with the inner peripheral surface of the cylinder 200 during the intake stroke, thereby preventing an internal leak and improving efficiency of the compressor 100.

Meanwhile, the vane 400*b* is folded into the receiving groove 330 of the rotor 300 by rotation of the rotor 300 during the compression stroke of the compressor 100. In this case, the contact point between the outside surface of the weight part 430*b* and the inner peripheral surface of the cylinder 200 is shifted in a direction (C→A) opposite to the rotation direction (direction indicated by the arrow) of the rotor 300 as illustrated in FIGS. 19 to 21.

In this case, the load in the compression chamber 230 is increased as the compression stroke proceeds. However, the friction is decreased since the rotation direction is opposite to the contact shifting direction, and thus generation of the wear is minimized.

In addition, the weight part 430*b* according to the third embodiment of the present invention may also have the counter weight 440 according to the above second embodiment.

Fourth Embodiment

Figure 22:
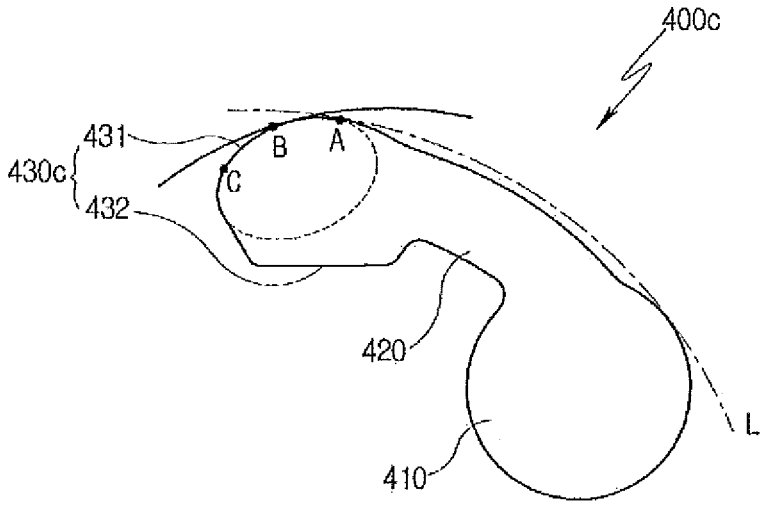
FIG. 22 is a cross-sectional view illustrating a vane according to a fourth embodiment of the present invention.

FIG. 22 is a cross-sectional view illustrating a vane 400*c* according to a fourth embodiment of the present invention.

The fourth embodiment of the present invention generally has configurations similar to those of the above-mentioned first embodiment, but differs from the first embodiment in that one side edge of a weight part 430*c* of each vane 400*c* is formed in an oval arc form having a predetermined curvature when viewed in section, for rolling friction.

Accordingly, the same configurations as those of the above-mentioned first embodiment are designated by the like reference numerals and duplicated description thereof will be omitted.

In the fourth embodiment of the present invention, the weight part 430*c* is formed to have an enlarged width at an end of a blade part 420, and an outside edge of the weight part 430*c*, namely, a surface facing the inner peripheral surface of the cylinder 200 is formed in an oval arc form having a predetermined curvature when viewed in section, as illustrated by the dotted line in FIG. 22.

In this case, the protrusion part 431 convexly protruding toward the inner peripheral surface of the cylinder 200 is formed on the outside surface of the weight part 430*e*. Accordingly, when an imaginary curve L having a predetermined curvature is depicted such that an outside surface of a hinge part 410 and an outside surface of the protrusion part 431 are simultaneously tangent to the imaginary curve L, an outside surface of the blade part 420 is formed inside the imaginary curve L. The blade part 420 is formed inside an imaginary circle in which one side of the hinge part 410 to one side of the weight part 430*c* are simultaneously inscribed.

Thus, when the rotor 300 rotates, the vane 400*c* is maintained in a state in which the weight part 430*c* always comes into contact with the inner peripheral surface of the cylinder 200. A contact point between the weight part 430*c* and the inner peripheral surface of the cylinder 200 is shifted along the contact shifting section (A~C) on the outside surface of the weight part 430*c*.

That is, in the fourth embodiment of the present invention, the tip portion of the vane 400*c* is moved along the inner peripheral surface of the cylinder 200 in a rolling friction manner in which the contact point is shifted along the contact shifting section (A~C) of the weight part 430*c*.

Meanwhile, since the weight part 430*e* has a larger width than that of the blade part 420, a center of gravity of the vane 400*c* is positioned away from a hinge center of the hinge part 410 to be formed close to the weight part 430*c*.

In this case, since the rotational moment of the vane 400*c* is increased by an increase in weight of the tip portion of the vane 400*c* by the weight part 430*c*, contact force between the tip portion of the vane 400*c* and the inner peripheral surface of the cylinder 200 is increased, thereby preventing an internal leak and improving efficiency of the compressor.

In this case, an inner side of the weight part 430*c*, namely, the other side facing the outer peripheral surface of the rotor 300 is preferably formed to have a flat surface 432. Thereby, the volume of the inner side of the weight part 430*e* is reduced and a center of gravity of the weight part 430*c* is biased outwardly, namely, toward the inner peripheral surface of the cylinder 200.

In addition, the weight part 430*c* according to the fourth embodiment of the present invention may also have the counter weight 440 according to the above second embodiment.

Fifth Embodiment

Figure 23:
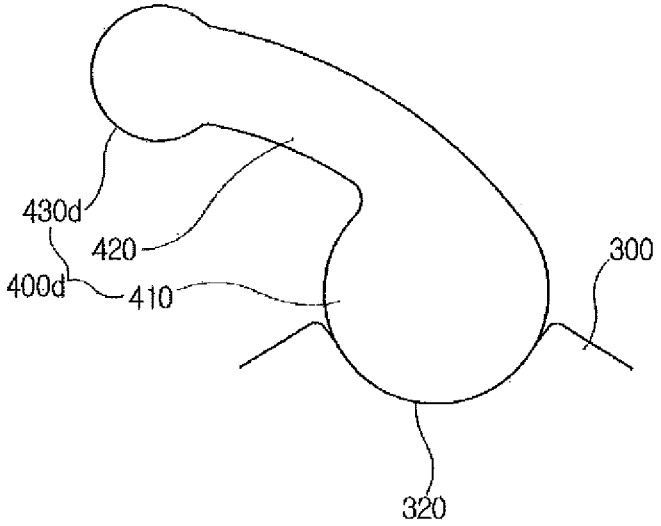
FIG. 23 is a cross-sectional view illustrating a vane according to a fifth embodiment of the present invention.

FIG. 23 is a cross-sectional view illustrating a vane 400*d* according to a fifth embodiment of the present invention.

The fifth embodiment of the present invention generally has configurations similar to those of the above-mentioned first embodiment, but differs from the first embodiment in that a weight part 430*d* of each vane 400*d* has a circular cross-sectional shape. Accordingly, the same configurations as those of the above-mentioned first embodiment are designated by the like reference numerals and duplicated description thereof will be omitted.

In the fifth embodiment of the present invention, the weight part 430*d* is formed at an end of a blade part 420 and has a circular cross-sectional shape as illustrated in FIG. 23.

In this case, the weight part 430*d* has a larger width than that of the blade part 420, and a central position of the weight part 430*d* may be properly selected as occasion demands. For example, an outside edge of the weight part 430*d* may protrude outward from a curve defined by an outside edge of the blade part 420, as illustrated in FIG. 23.

Alternatively, the outside edge of the weight part 430*d* may also be formed to be inscribed in the curve defined by the outside edge of the blade part 420.

Meanwhile, as a modification example of the fifth embodiment of the present invention, the weight part may have a polygonal cross-sectional shape such as triangle, quadrangle, or pentagon. Of course, in this case, the weight part 430*d* should have a larger width than that of the blade part such that a center of gravity of the vane 400*d* is formed close to the weight part.

In addition, one section of the edge of the weight part 430*d* facing the inner peripheral surface of the cylinder 200 may also have a oval arc shape such that the tip portion of the vane 400*d* according to the fifth embodiment of the present invention and the modification example thereof comes into contact with the inner peripheral surface of the cylinder 200 in a rolling friction manner.

In addition, the weight part 430*d* according to the fifth embodiment of the present invention may also have the counter weight 440 according to the above second embodiment.

Sixth Embodiment

Figure 24:
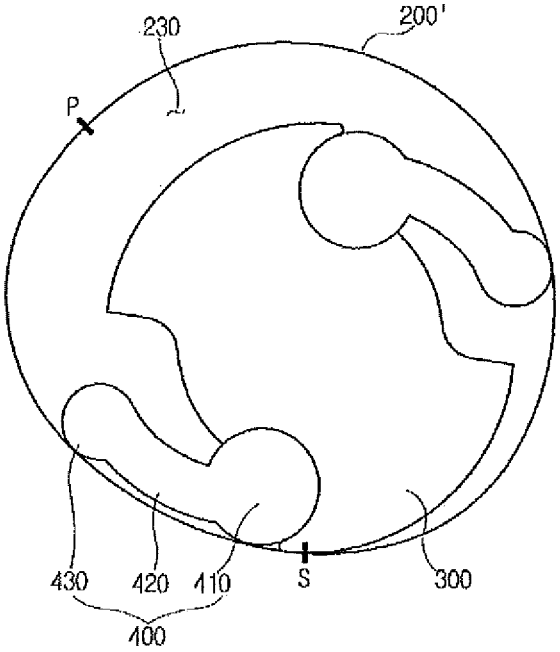
FIG. 24 is a cross-sectional view illustrating a vane rotary compressor in which an inner peripheral surface of a cylinder has an involute curve form according to a sixth embodiment of the present invention.

FIG. 24 is a cross-sectional view illustrating a vane rotary compressor in which an inner peripheral surface of a cylinder 200' has an involute curve form according to a sixth embodiment of the present invention.

The sixth embodiment of the present invention generally has configurations similar to those of the above-mentioned embodiments, but differs from the above embodiments in that an inner peripheral surface of a hollow of the cylinder 200' has an involute curve form and the cylinder 200' and the rotor 300 have the same center axis. Accordingly, the same configurations as those of the above-mentioned first embodiment are designated by the like reference numerals and duplicated description thereof will be omitted.

Meanwhile, although an example in which the vane 400*d* having a circular cross-sectional shape according to the above-mentioned fifth embodiment is applied to the embodiment illustrated in FIG. 24 is described, the vanes 400, 400*a*, 400*b*, and 400*c* according to the first to fourth embodiment may also be applied to the present embodiment.

In the sixth embodiment of the present invention, the inner peripheral surface of the hollow of the cylinder 200' has an involute curve form and the rotor 300 is installed in the hollow of the cylinder 200' such that the inner peripheral surface of the cylinder 200' and the outer peripheral surface of the rotor 300 have the same center when viewed in section.

That is, in the involute curve depicted along the inner peripheral surface of the cylinder 200', centers of a start point and an end point coincide with the center of the rotor 300. Consequently, vibration and noise may be reduced in the present embodiment, compared to the above-mentioned embodiments in which the rotor 300 is eccentrically disposed.

In the drawing, when the vane 400*d* passes through an intake section (S→P) along clockwise rotation of the rotor 300, an intake stroke proceeds while a distance between the cylinder 200' and the rotor 300 is gradually increased. On the other hand, when the vane 400*d* passes through a compression section (P→S), a compression stroke proceeds while the distance between the cylinder 200' and the rotor 300 is gradually decreased.

In this case, the vane 400*d* has an increased rotational moment by the weight part 430*d*, thereby preventing a delay of rotation operation of the vane 400*d* and generation of hitting noise caused as in the related art. In addition, since one side of the weight part 430*d* protrudes outward of the blade part 420, the weight part 430*d* is moved in a state of continuously coming into contact with the inner peripheral surface of the cylinder 200'.

Various embodiments have been described in the best mode for carrying out the invention.

INDUSTRIAL APPLICABILITY

In accordance with the vane rotary compressor 100 according to the exemplary embodiments of the present invention, since the weight part 430, 430*a*, 430*d*, 430*c*, 430*d* is enlarged and formed at the tip portion of the vane 400, 400*a*, 400*b*, 400*c*, 400*d* and thus the center of gravity of the vane 400, 400*a*, 400*b*, 400*c*, 400*d* is formed at one side of the tip portion, the vane 400, 400*a*, 400*b*, 400*c*, 400*d* may have an increased rotational moment compared to the related art.

Thus, it may be possible to prevent generation of hitting noise due to a delay of rotation operation of the vane 400, 400*a*, 400*b*, 400*c*, 400*d* when the rotor 300 rotates and to reduce an internal leak. Consequently, the compressor 100 may have improved performance.

In this case, since the counter weight 440 made of a material having a greater specific gravity than that of the vane 400, 400*a*, 400*b*, 400*c*, 400*d* is inserted into the weight part 430, 430*a*, 430*d*, 430*c*, 430*d* of the vane, the vane 400, 400*a*, 400*b*, 400*c*, 400*d* may have an increased rotational moment.

In addition, since the shifting distance of the contact point between the tip portion of the vane 400, 400*a*, 400*b*, 400*c*, 400*d* and the inner peripheral surface of the cylinder 200, 200' is increased when viewed in section, rolling friction characteristics are exhibited. Therefore, the compressor 100 may have improved durability by minimizing generation of wear, compared to the related art exhibiting sliding friction characteristics.

In this case, since the shifting direction of the contact point is equal to the rotation direction of the rotor 300 during an intake stroke in which a load in the compression chamber 230 is small whereas the shifting direction of the contact point is opposite to the rotation direction of the rotor during the compression stroke in which the load in the compression chamber 230 is great, friction may be efficiently reduced.

Although the present invention has been described with respect to the illustrative embodiments, it will be apparent to those skilled in the art that various variations and modifications may be made without departing from the spirit and scope of the invention as defined in the following claims.

The invention claimed is:

1. A vane rotary compressor comprising:

a hollow cylinder;

a rotor rotatingly disposed in the cylinder;

a vane including a first end hingedly coupled to an outer peripheral surface of the rotor and a weight part formed at a second end of the vane, the weight part configured to position a center of gravity of the vane proximate the weight part, the weight part having an insertion groove with a predetermined depth, the vane biasing towards an inner surface of the cylinder; and a counter weight disposed in the insertion groove of the weight part for increasing a weight of the weight part.

2. The vane rotary compressor of claim 1, wherein the vane is formed from a first material and the counter weight is formed from a second material, the second material having a specific gravity greater than a specific gravity of the first material.

3. The vane rotary compressor of claim 1, wherein the vane includes a hinge part coupling the vane to the rotor and a blade part extending arcuately between the hinge part and the weight part, the center of gravity positioned a distance from a hinge center of the hinge part.

4. The vane rotary compressor of claim 3, wherein a width of the weight part is greater than a width of the blade part.

5. The vane rotary compressor of claim 1, wherein the weight part has a curved surface extending outwardly therefrom towards the inner surface of the cylinder.

6. The vane rotary compressor of claim 1, wherein the weight part has a circular cross-sectional shape.

7. The vane rotary compressor of claim 1, wherein the weight part has an oval cross-sectional shape.

8. The vane rotary compressor of claim 1, wherein the weight part has a polygonal cross-sectional shape.

9. The vane rotary compressor of claim 1, wherein the weight part has a first surface facing the cylinder and a second surface facing the rotor, and wherein the first surface is arcuate and the second surface is substantially flat.

10. The vane rotary compressor of claim 9, wherein the first surface of the weight part rollingly and frictionally engages the inner surface of the cylinder.

11. The vane rotary compressor of claim 10, wherein the first surface of the weight part and the inner surface of the cylinder engage each other at a contact point, wherein the contact point shifts along the first surface in a direction of rotation of the rotor during an intake stroke of the vane rotary compressor, and wherein the contact point shifts along the first surface in a direction opposite of the direction of rotation of the rotor during a compression stroke of the vane rotary compressor.

12. The vane rotary compressor of claim 11, wherein the contact point shifts along a shifting section formed on the first surface, the shifting section having a predetermined arc length.

13. The vane rotary compressor of claim 1, wherein the inner surface of the cylinder has an involute cross-sectional shape.

14. A vane rotary compressor comprising:

a hollow cylinder;

a rotor eccentrically disposed in the cylinder;

a vane including a hinge part hingedly coupled to an outer peripheral surface of the rotor, a weight part, and a blade part extending between the hinge part and the weight part, the weight part having a width greater than a width of the blade part, the weight part and the inner surface of the cylinder rollingly and fictionally engaging each other at a contact point, the contact point shifts along a shifting section formed on a surface of the weight part; the weight part having an insertion groove with a predetermined depth; and a counter weight disposed in the insertion groove of the weight part for increasing a weight of the weight part.

15. The vane rotary compressor of claim 14, wherein the vane is formed from a first material and the counter weight is formed from a second material, the second material having a specific gravity greater than a specific gravity of the first material.

16. The vane rotary compressor of claim 14, wherein a center of gravity of the vane is configured a distance from a hinge center of the hinge part and proximate the weight part.

17. The vane rotary compressor of claim 14, wherein the weight part has an arcuate surface facing the cylinder, the arcuate surface and the inner surface of the cylinder engaging each other at the contact point, wherein the contact point shifts along the arcuate surface in a direction of rotation of the rotor during an intake stroke of the vane rotary compressor, and wherein the contact point shifts along the arcuate surface in a direction opposite of the direction of rotation of the rotor during a compression stroke of the vane rotary compressor.

18. The vane rotary compressor of claim 17, wherein the contact point shifts along a shifting section formed on the arcuate surface, the shifting section having a predetermined arc length.

* * * * *